US006783163B2

(12) United States Patent
Sadler

(10) Patent No.: US 6,783,163 B2
(45) Date of Patent: Aug. 31, 2004

(54) FLOATING RECEIVING MECHANISM FOR A HANDLE ASSEMBLY AND HANDLE ASSEMBLY INCLUDING SAME

(75) Inventor: Dennis Sadler, Irmo, SC (US)

(73) Assignee: Randall C. Hansen, Columbia, SC (US)

( * ) Notice: Subject to any disclaimer, the term of this patent is extended or adjusted under 35 U.S.C. 154(b) by 0 days.

(21) Appl. No.: 10/043,578

(22) Filed: Jan. 10, 2002

(65) Prior Publication Data

US 2002/0056297 A1 May 16, 2002

Related U.S. Application Data

(63) Continuation of application No. 09/426,626, filed on Oct. 26, 1999.

(51) Int. Cl.[7] ..... E05B 15/02

(52) U.S. Cl. ..... 292/341.18; 292/DIG. 60; 292/340

(58) Field of Search ..... 292/341.18, 341.19, 292/340, 341, DIG. 55, DIG. 60

(56) References Cited

U.S. PATENT DOCUMENTS

| | | | | | |
|---|---|---|---|---|---|
| 2,884,277 | A | * | 4/1959 | Hale | 292/341.18 |
| 3,265,427 | A | * | 8/1966 | Williams | 292/341.18 |
| 3,302,434 | A | | 2/1967 | Dauenbaugh et al. | |
| 4,424,691 | A | * | 1/1984 | Foshee | 70/224 |
| 4,597,599 | A | * | 7/1986 | Bisbing | 292/174 |
| 4,613,176 | A | * | 9/1986 | Kelly | 292/201 |
| 4,835,997 | A | | 6/1989 | Akright | |
| 5,467,619 | A | | 11/1995 | Stillwagon et al. | |
| 5,757,269 | A | * | 5/1998 | Roth et al. | 340/542 |
| 5,875,948 | A | | 3/1999 | Sadler | |
| 5,941,104 | A | | 8/1999 | Sadler | |
| 5,983,682 | A | | 11/1999 | Parikh | |
| 5,984,383 | A | | 11/1999 | Parikh et al. | |
| 6,048,006 | A | | 4/2000 | Antonucci et al. | |
| 6,149,213 | A | | 11/2000 | Sokurenko et al. | |
| 6,240,752 | B1 | | 6/2001 | Larsen et al. | |
| 6,318,772 | B1 | * | 11/2001 | Pearson | 292/341.18 |

OTHER PUBLICATIONS

Drawing, dated Aug. 25, 1998, of New Holland rotatable head latch.

* cited by examiner

*Primary Examiner*—John B. Walsh
(74) *Attorney, Agent, or Firm*—Dority & Manning, P.A.

(57) ABSTRACT

A floating receiving mechanism is disclosed for use with a handle assembly including a base member defining a central opening therethrough, and a substantially U-shaped keeper having a base portion defining a central opening therethrough and two arms extending from the base portion. The keeper is attached to the base plate so that the keeper central opening is substantially aligned with the base plate central opening and so that the keeper is slidable laterally relative to the base plate. The keeper is configured for releasably retaining an extending portion of the handle assembly. The extending portion may be a member such as a keeper stud. Other receiving mechanisms and related handle latch assemblies are also disclosed.

49 Claims, 9 Drawing Sheets

FLOATING RECEIVING MECHANISM FOR A HANDLE ASSEMBLY AND HANDLE ASSEMBLY INCLUDING SAME

RELATED APPLICATIONS

The present application is a continuation of U.S. patent application Ser. No. 09/426,626, filed Oct. 26, 1999, the disclosure of which is incorporated herein by reference.

FIELD OF THE INVENTION

The present invention relates to a floating receiving mechanism for a paddle handle actuated latching mechanism and to a handle assembly including such a mechanism. More particularly, the present invention relates to use of a floating mechanism that provides self-alignment with a latch assembly, suitable for use on an item such as a truck box.

BACKGROUND OF THE INVENTION

Boxes and containers designed to fit securely within the bed of a pick-up truck have become increasingly popular. Such boxes are extensively used by tradesmen and contractors who require a secure storage compartment for holding tools and equipment and require a secure lockable container for their equipment.

Different lid arrangements are known in the art including wing-style lids which open along each side of the box as well as a single hinged lid which opens along a length of the box.

One such locking lid arrangement can be found in U.S. Pat. No. 5,226,302 to Anderson assigned to Loctec Corporation which is incorporated herein by reference. This reference provides a latch mechanism in which a notched plunger is mounted from an overhead lid of the truck box. As the plunger is inserted into an opening of the latch assembly, the plunger self-adjusts for proper alignment and results in a lock self-adjustable in six directions.

U.S. Pat. No. 5,941,104 to Sadler, which is incorporated herein by reference, is directed toward a paddle lock which provides a latching mechanism which latches and unlatches upon a striker element and is actuated by movement of the handle member.

While the examples discussed above provide useful latching mechanisms, there remains room for variation and improvement within the art.

SUMMARY OF THE INVENTION

It is therefore an object of the present invention to provide a receiving mechanism for a handle assembly having a self-adjusting feature to facilitate the alignment and engagement of the handle assembly within the receiving mechanism.

According to one aspect of the invention, a floating receiving mechanism is disclosed for use with a handle assembly including a base plate defining a central opening and at least two side openings therethrough. The side openings are located on opposite sides of the central opening. A keeper defines a central opening therethrough. The keeper is attached to the base plate via connection members extending from the keeper through the side openings so that the keeper central opening is substantially aligned with the base plate central opening. Each connection member is sized so as to be slidable laterally in a respective side opening to thereby allow the keeper to move laterally relative to the base plate. The keeper is configured for releasably retaining an extending portion of the handle assembly.

If desired, the keeper may be substantially U-shaped, or may have a base portion and two arms extending from the base portion, the central opening being defined in the base portion. Each of the arms may terminate in a lip.

Also, the extending portion of the handle assembly may be a rotatable member, the rotatable member being insertable into the keeper in any position of rotation and being withdrawable from the keeper stud in at least one unlocked position of rotation. The rotatable member may thus be operatively connected to the handle assembly, and the rotatable member may be a keeper stud having a first terminus defining at least one notch, the notch engaging the keeper when the keeper stud is in a locked position of rotation and disengaging the keeper when the keeper stud is in the unlocked position of rotation. The keeper stud may include a plurality of the notches arranged in at least one pair. The base plate may be secured to a lid of a container and the handle assembly may be secured to the container.

According to another aspect of the invention, a floating receiving mechanism is disclosed for use with a handle assembly including a base member defining a central opening therethrough. A substantially U-shaped keeper has a base portion defining a central opening therethrough and two arms extending from the base portion. The keeper is attached to the base member so that the keeper central opening is substantially aligned with the base member central opening and so that the keeper is slidable laterally relative to the base member. The keeper is configured for releasably retaining an extending portion of the handle assembly.

A means may be provided for slidably connecting the base member and the keeper. The means for slidably connecting may include connection members slidable in openings, and the openings may be slots located in the base member.

According to another aspect of the invention, a handle latch assembly is disclosed including a handle assembly including a rotatable member actuatable by a handle. The handle assembly is mountable on a first surface and has an extending portion. A receiving mechanism is provided for releaseably securing the extending portion. The receiving mechanism is mountable on a second surface movable relative to the first surface. The receiving mechanism includes a base member defining a central opening therethrough. A substantially U-shaped keeper is provided having a base portion defining a central opening therethrough and two arms extending from the base portion. The keeper is attached to the base member so that the keeper central opening is substantially aligned with the base member central opening and so that the keeper is slidable laterally relative to the base member. The keeper is configured for releasably retaining an extending portion of the handle assembly.

These and other features, aspects, and advantages of the present invention will become better understood with reference to the following description and appended claims.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings.

DESCRIPTION OF THE PREFERRED EMBODIMENT

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in, or are obvious from, the following detailed description. It is to be understood by one of ordinary skill in the art that the present discussion is a description of exemplary embodiments only and is not intended as limiting the broader aspects of the present invention, which broader aspects are embodied in the exemplary constructions.

Figure 1:
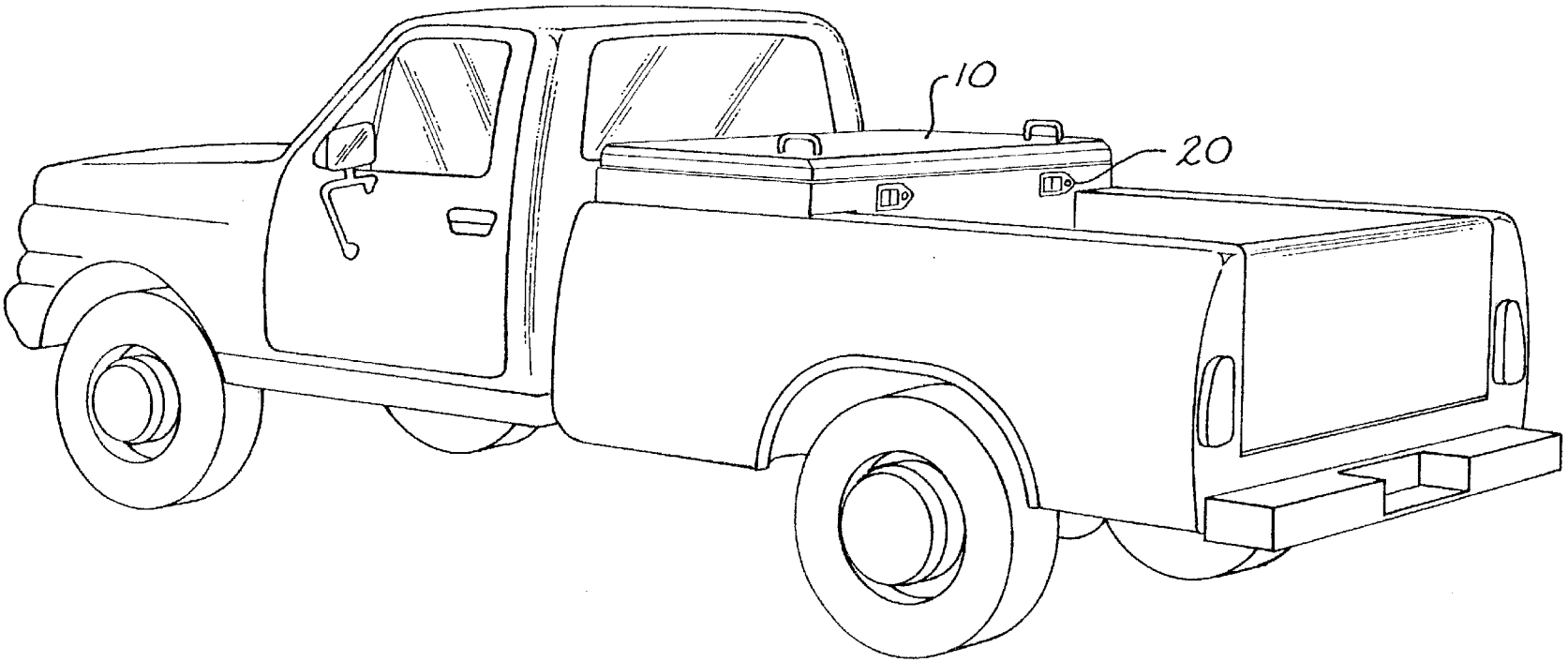
FIG. 1 is a perspective view of the present invention utilized as a latching mechanism for a truck box carried within the bed of a truck.
Figure 2:
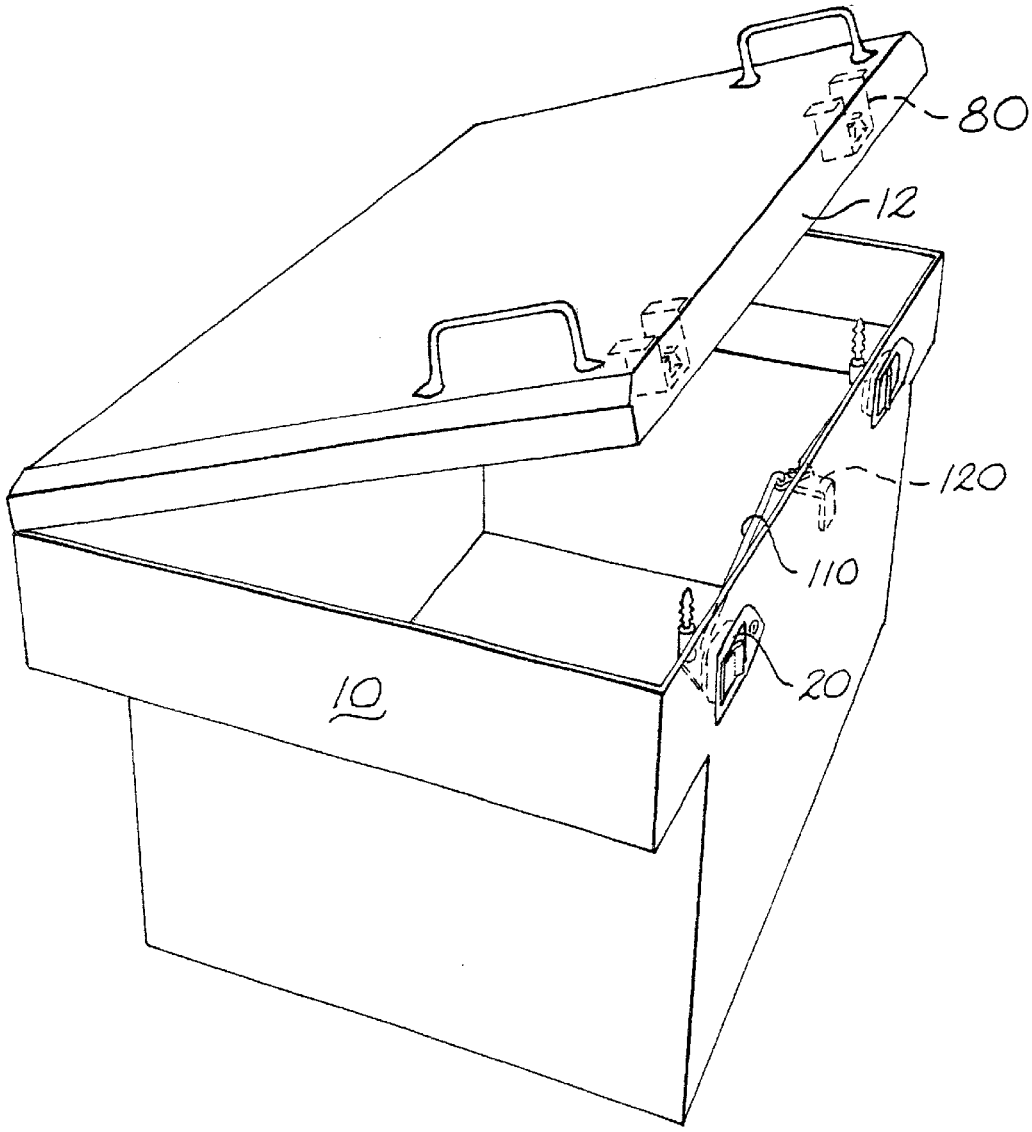
FIG. 2 is an elevated perspective view of an embodiment of the latch mechanism in relation to a truck cargo box.
Figure 3:
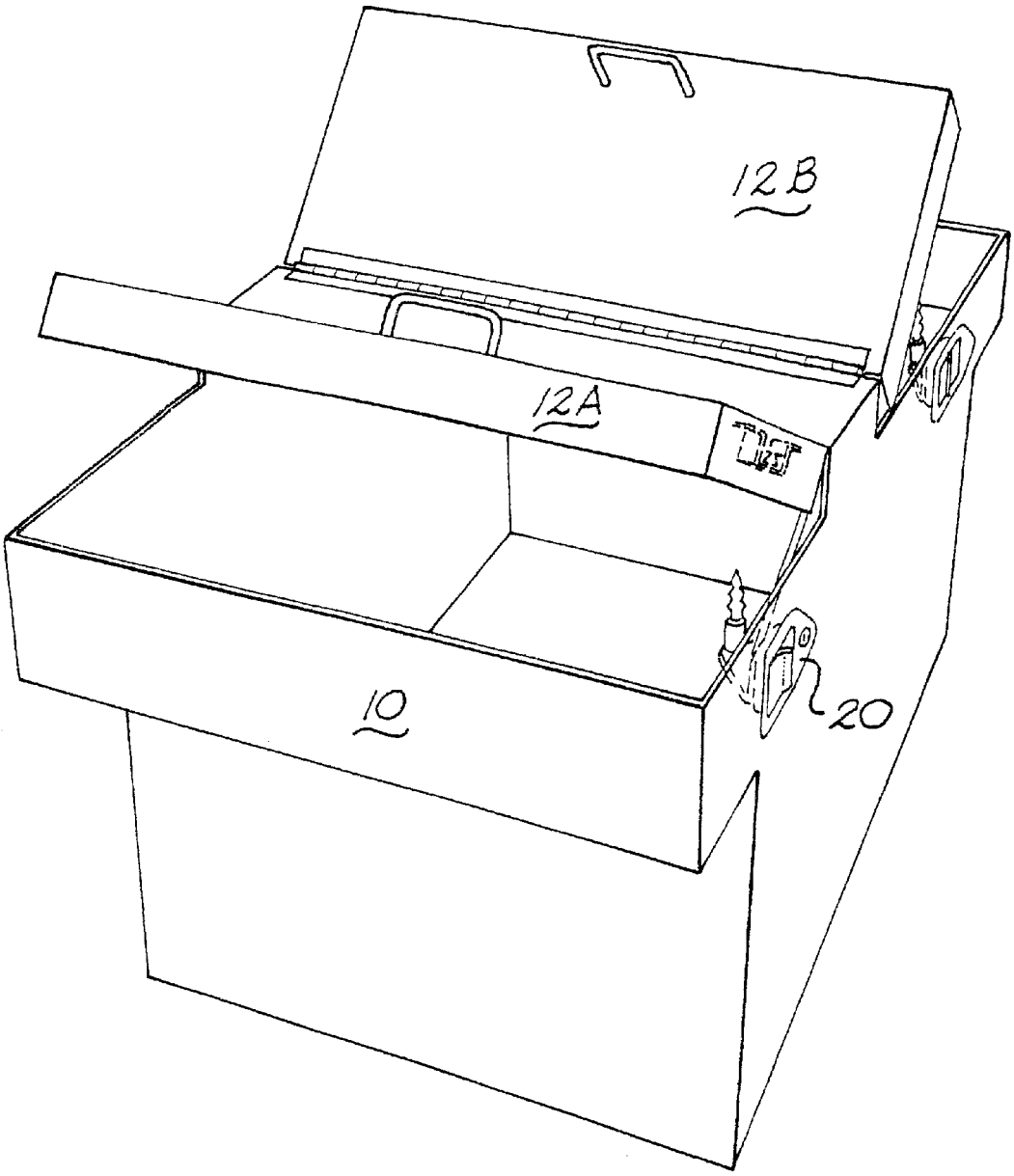
FIG. 3 is an elevated perspective view of an alternative cargo box arrangement utilizing a latching mechanism of the present invention.

The latch assembly according to the invention is illustrated in the figures generally as element 20. FIGS. 1 and 2 illustrate one embodiment of latch assembly 20 as a latch or lock element for a hinged lid cargo box 10. FIG. 3 further illustrates latch assembly 20 in an alternative embodiment as a tandem latching assembly for two separate hinged lids 12A and 12B. FIGS. 1–3 are only meant to illustrate a few of the possible environments of the invention. For example, the individual handle trays could be placed on the sides of the box if desired, which may be preferred in a box such as in FIG. 3. It should be understood that the latch assembly, according to the invention, can be used in any number of environments, including panel doors of a utility truck, recreational vehicle, or any manner of commercial vehicles, lock boxes, marine applications, etc.

Referring to the figures in general, latch assembly 20 includes a housing or tray generally 22. Tray 22 has a front side 24 and a back side 26. Tray 22 may also serve as part of the means for mounting the latch assembly on a vehicle and in this regard may define a flange 28 around the circumference thereof. Flange 28 may define a plurality of mounting apertures 29 and, in one mounting configuration, would circumscribe an opening defined in the cargo box or other housing in which the latch assembly is mounted. It should, however, be understood and appreciated that the flange 30 is not a critical feature of the invention, and merely provides one means for mounting the latch assembly. Any manner of conventional devices as may be used and known within the prior art to mount a latch assembly may be employed, such as adhesives, separate mounting brackets, and other conventional mounting devices and means.

Figures 5, 6:
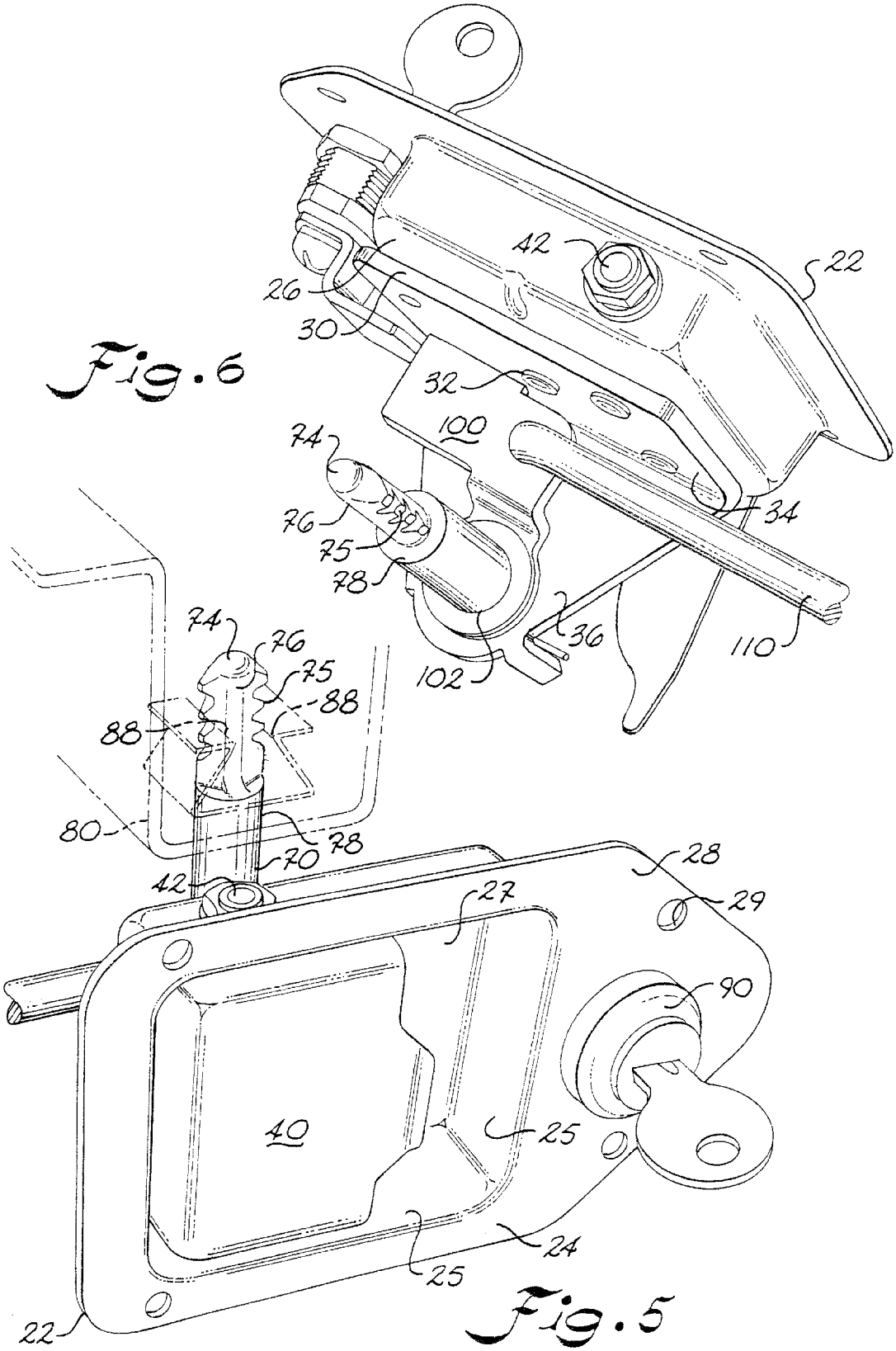
FIG. 5 is a front perspective view of the latch assembly illustrating the keeper stud secured in a locked position of the receiving mechanism.
FIG. 6 is an elevated rear perspective view of latch assembly illustrating the rotating keeper stud in relation to an optional linkage rod in communication with the operating member.

As seen in FIG. 5, handle assembly 20 also includes a handle member 40, seen here as a paddle handle. However, handle 40 may take the form of any number of desired configurations. Handle 40 is mounted on the front side 24 of tray 22 so that it can be pulled outward, as particularly seen in FIGS. 9B and 9C. In a preferred embodiment, handle 40 is pivotally mounted by way of axle 42 to tray 22. Tray 22 further defines side wall members 25 which define a cavity 27. This arrangement positions the front surface of handle member 40 substantially flush within cavity 27 as particularly seen in FIG. 5.

The back side 26 of tray 22 has a mounting bracket 30 attached. As seen in reference to FIGS. 6 and 7, mounting bracket 30 defines a flat plate 34 which is attached with rivets 32 to tray back side 26. A support arm 36 extends substantially perpendicular away from the flat plate 34 and back side 26 of tray 22. As best described below, mounting bracket 30 is used to support and position additional components of the latch assembly.

Referring particularly to FIGS. 7 and 9A–9C, an actuating member 50 is operatively connected to handle member 40 to pivot therewith. Actuating member 50 is mounted on a portion of axle 42 that extends through side wall 25 of tray 22. Thus, actuating member 50 is rotatable with handle 40 to actuate the mechanism on the back side 26 of tray 22. As seen in the figures, actuating member 50 may comprise a piece of flat metal having a leading edge 52 which may comprise an arcuate or otherwise curved edge, the actuating member being used to actuate further elements of the latch assembly.

Figure 7:
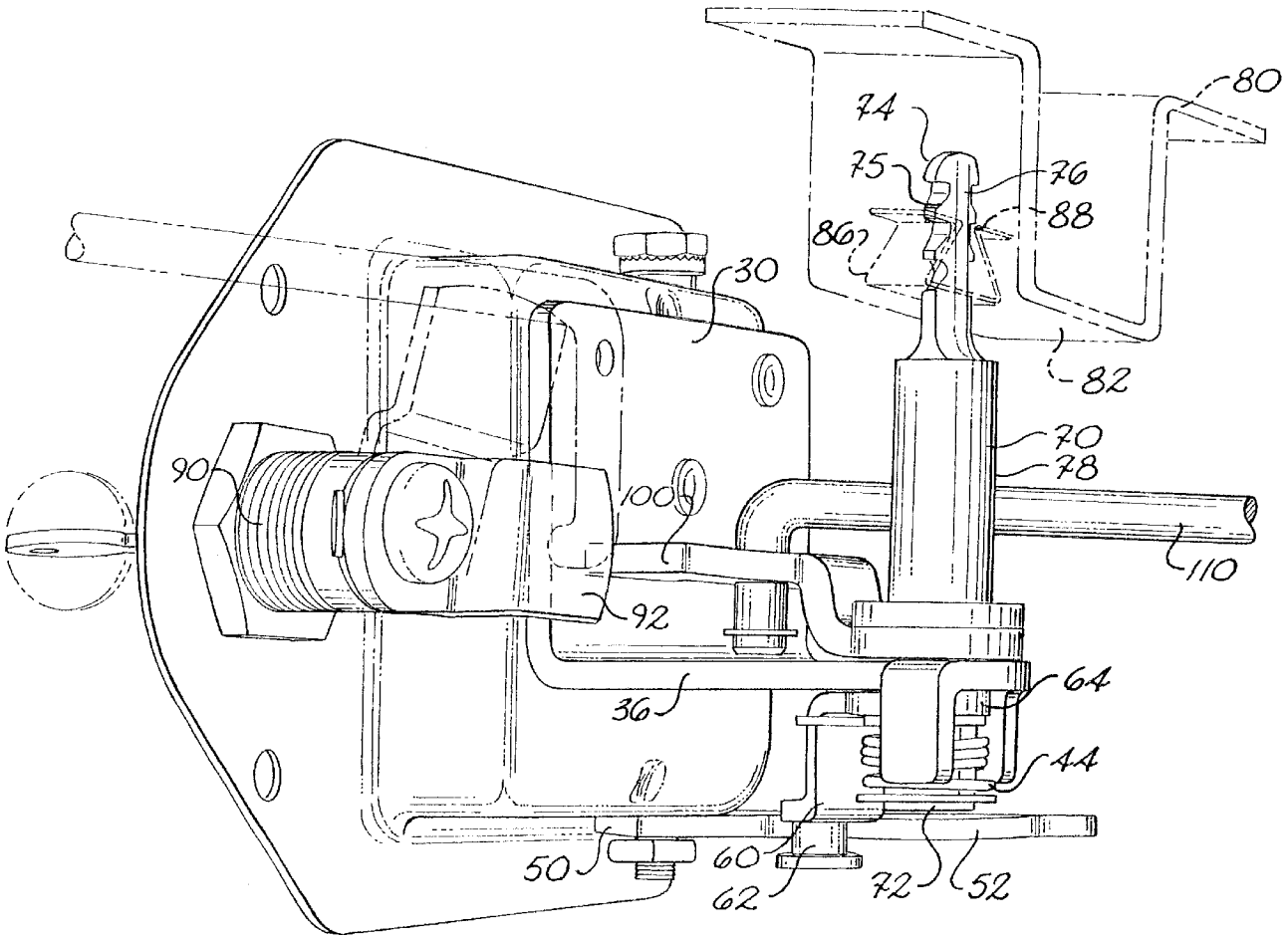
FIG. 7 is a back view of the latch assembly illustrating the latching mechanism in a locked position.
Figure 8:
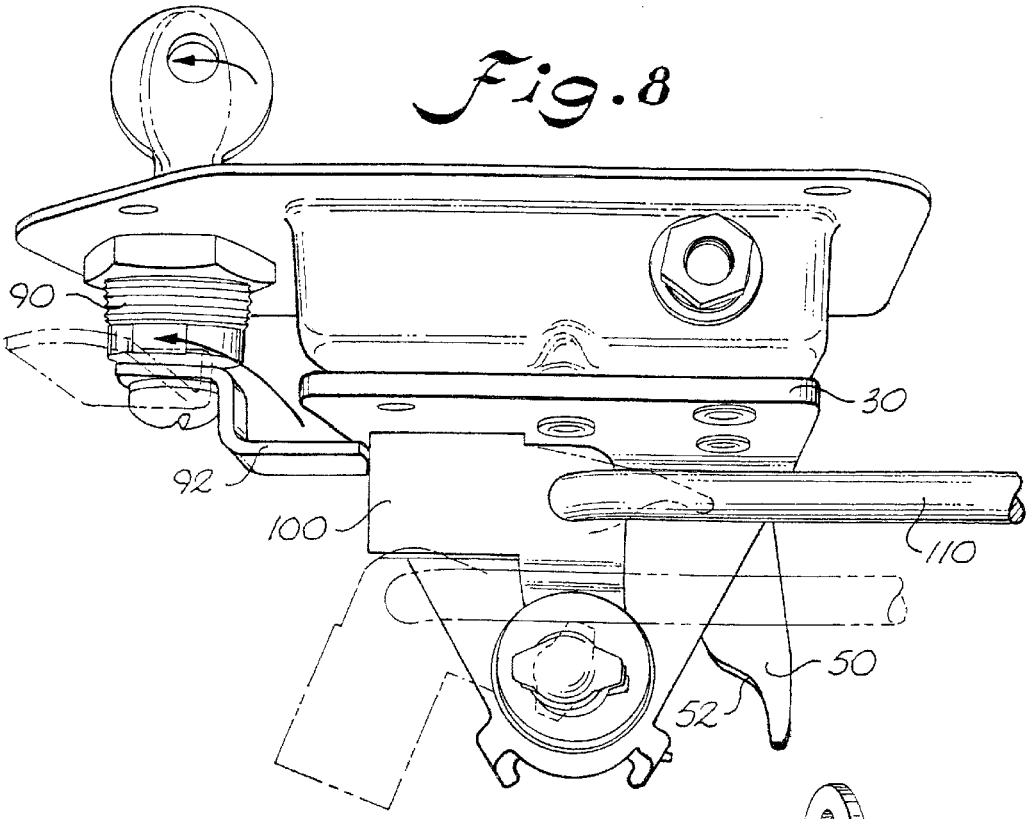
FIG. 8 is a top perspective view, similar to FIG. 6, showing the relative movement of a locking cam member and the operating member with the engaging portion of the keeper stud removed for purposes of clarity.
Figure 9A:
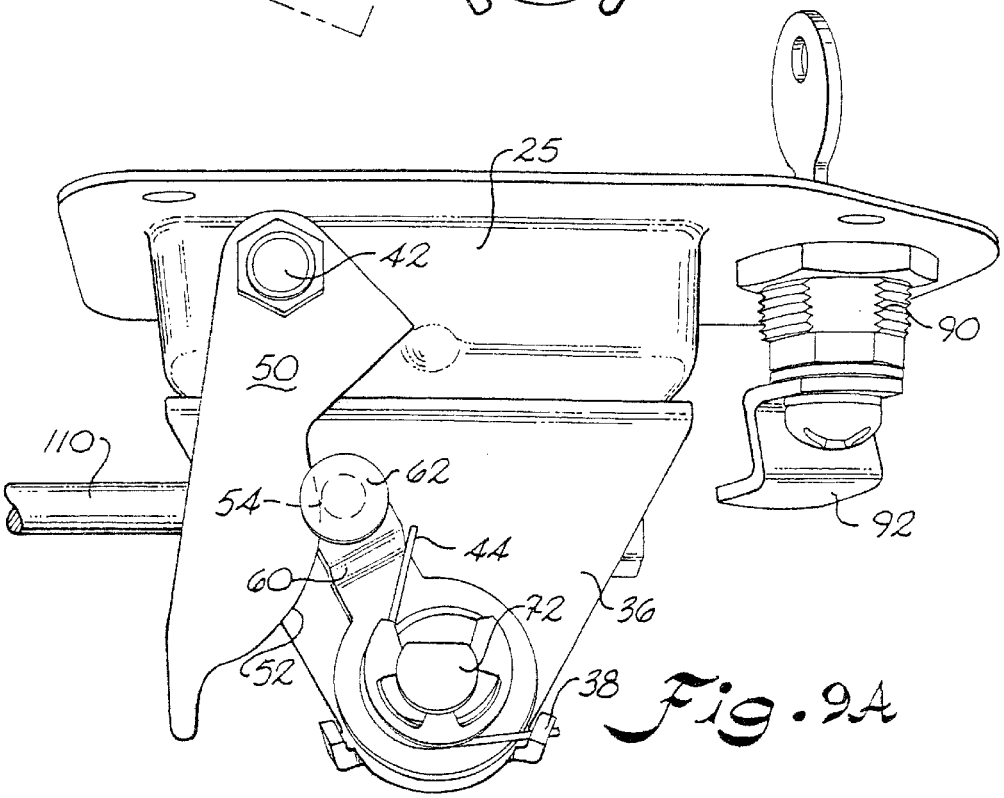
FIG. 9A is a bottom perspective view of the latch assembly as seen in FIG. 6.
Figure 9B:
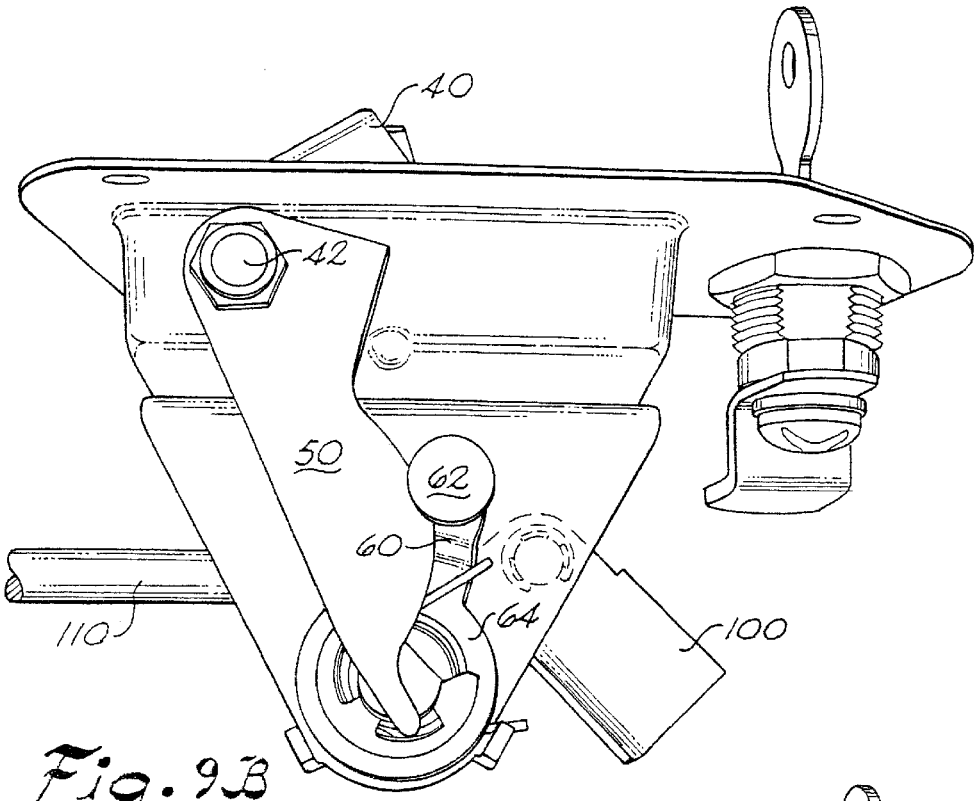
FIG. 9B is a bottom perspective view, similar to FIG. 9A, showing the handle member, actuating member, and operating member in open and unlocked configuration.
Figure 9C:
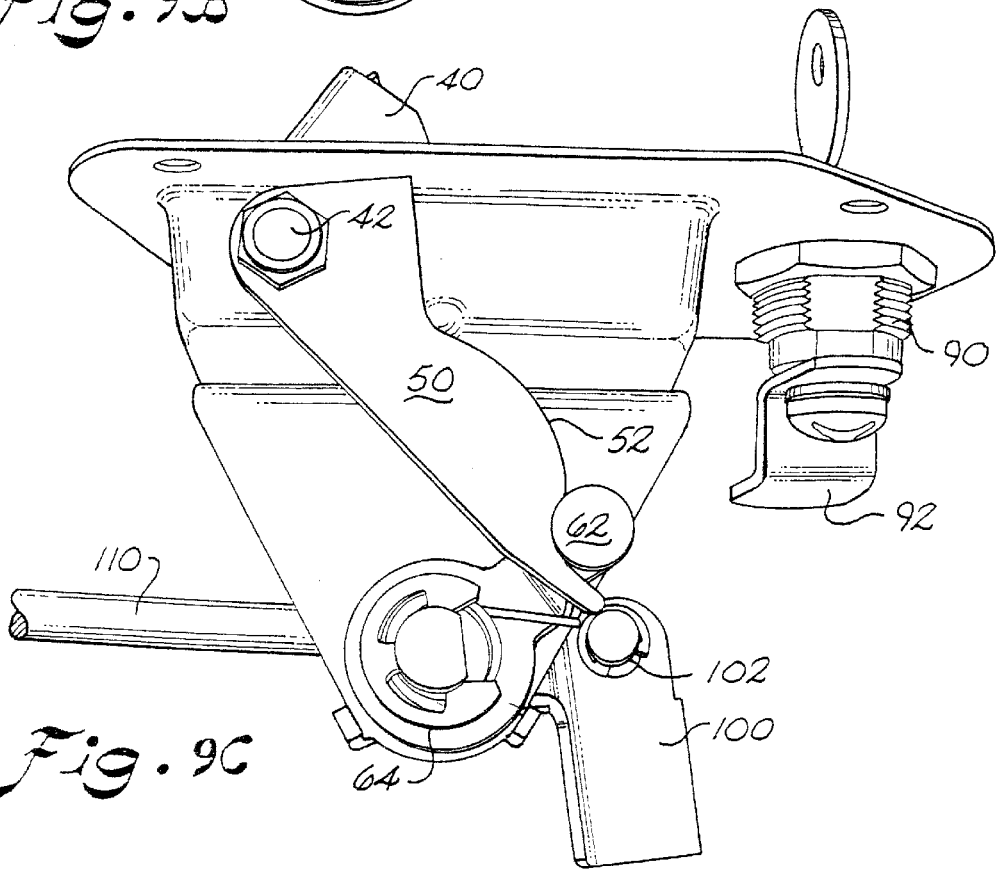
FIG. 9C is a view similar to FIG. 9B showing the handle member, actuating member, and operating member in a fully engaged and unlocked position.

Edge 52 of actuating member 50 engages an operating member 60 mounted for pivotal or rotational movement on back side 26 of tray 22. In the embodiment illustrated, operating member 60 is mounted so as to engage and rotate a base 72 of keeper stud 70. As seen in FIGS. 7, 9A, and 9C, base 72 of keeper stud 70 traverses an aperture defined by support arm 36, this arrangement maintaining keeper stud 70 substantially parallel to the plane of the flat tray back side 26. The operating member 60 defines a collar 64 through which keeper stud base 72 passes, collar 64 gripping an outer perimeter of the base 72. Operating member 60 further defines a pin 62 which is positioned opposite the arcuate edge 52 of actuating member 50. As best seen in reference to FIG. 9A, edge 52 defines a convex surface. As seen in reference to the sequential positions seen in FIGS. 9A–9C, a shoulder region 54 initially engages the cam 62 of operating member 60. As actuating member 50 is pivoted, shoulder 54 continues to engage cam 62 as the actuating member 50 pivots operating member 60. As seen in the intermediate position of FIG. 9B, shoulder 54 and cam 62 continue to make contact along a substantial travel distance of the actuating member 50 and operating member 60. As the engagement continues (FIG. 9C), the peak and far shoulder of edge 52 engage cam 62 and fully extend the operating member. Accordingly, operating member 60 is movable by the engagement of the edge 52 relative to pin 62 allowing movement between a locked position (FIG. 9A), an intermediate position (FIG. 9B) and an unlocked position (FIG. 9C). When so engaged, the displacement of operating member 60 by edge 52 rotates collar 64 which, in turn, rotates base 72 and keeper stud 70.

A coil spring 44 is used to provide a tensioned return mechanism for the latch assembly upon the release of handle 40. Spring 44 is wrapped around base 72 with one end of spring 44 engaging a projection 38 (FIG. 9A) of support arm 36, a second end of spring 44 in communication with operating member 60. In the illustrated embodiments, the coil spring 44 acts upon operating member 60 to urge operating member and the interlinked components toward an initial configuration.

Figure 10:
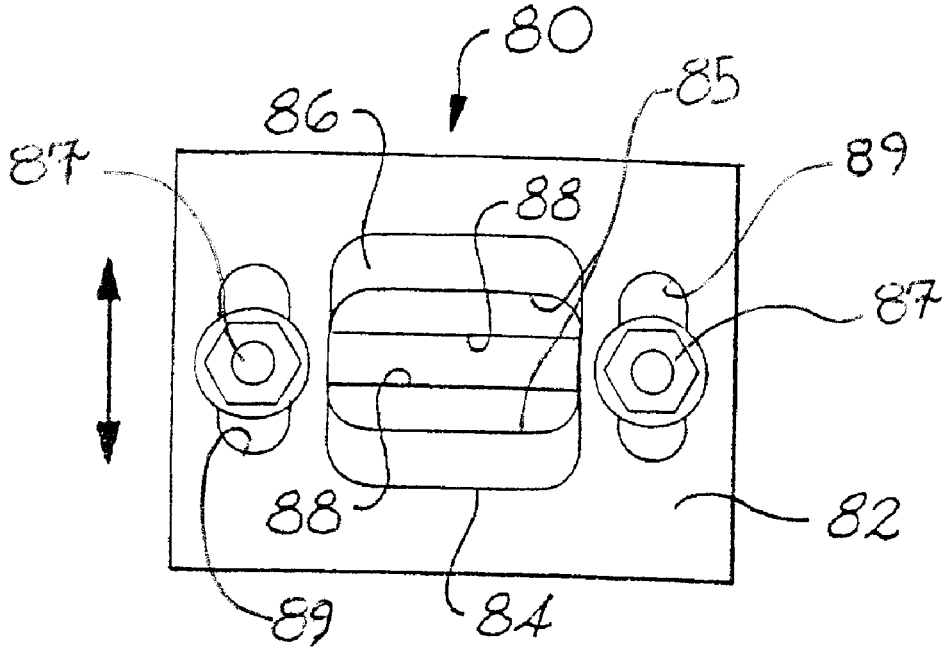
FIG. 10 is a plan view of a front face of the receiving mechanism of the latch assembly.

A distal end 74 of keeper stud 70 is defined partially by a plurality of notches 75 (defining teeth therebetween) on opposing side walls. As best seen in reference to FIGS. 5–7, distal end 74 further defines a pair of opposing smooth surfaced beveled walls 76 positioned at an approximate right angle to the opposing side walls defining notches 75. A cylindrical midsegment 78 of keeper stud 70 interconnects the distal end 74 with the base 72. The notches 75 and beveled walls 76 of keeper stud 70 will operatively engage a receiving mechanism 80 as best seen in reference to FIGS. 5, 7, and 10. Receiving mechanism 80 provides a face plate (or base plate) 82 such as a surface of a support bracket or other housing. Plate 82 defines an opening 84 in communication with an adjacent aligned keeper 86 having an opening 85 aligned with opening 84. Keeper 86 is slidably movable by movement of connection members such as bolts 87 or rivets within a pair of attachment slots 89 defined by face plate 82, the slots allowing movement of keeper 86 as indicated by directional arrow in FIG. 10.

Figure 4:
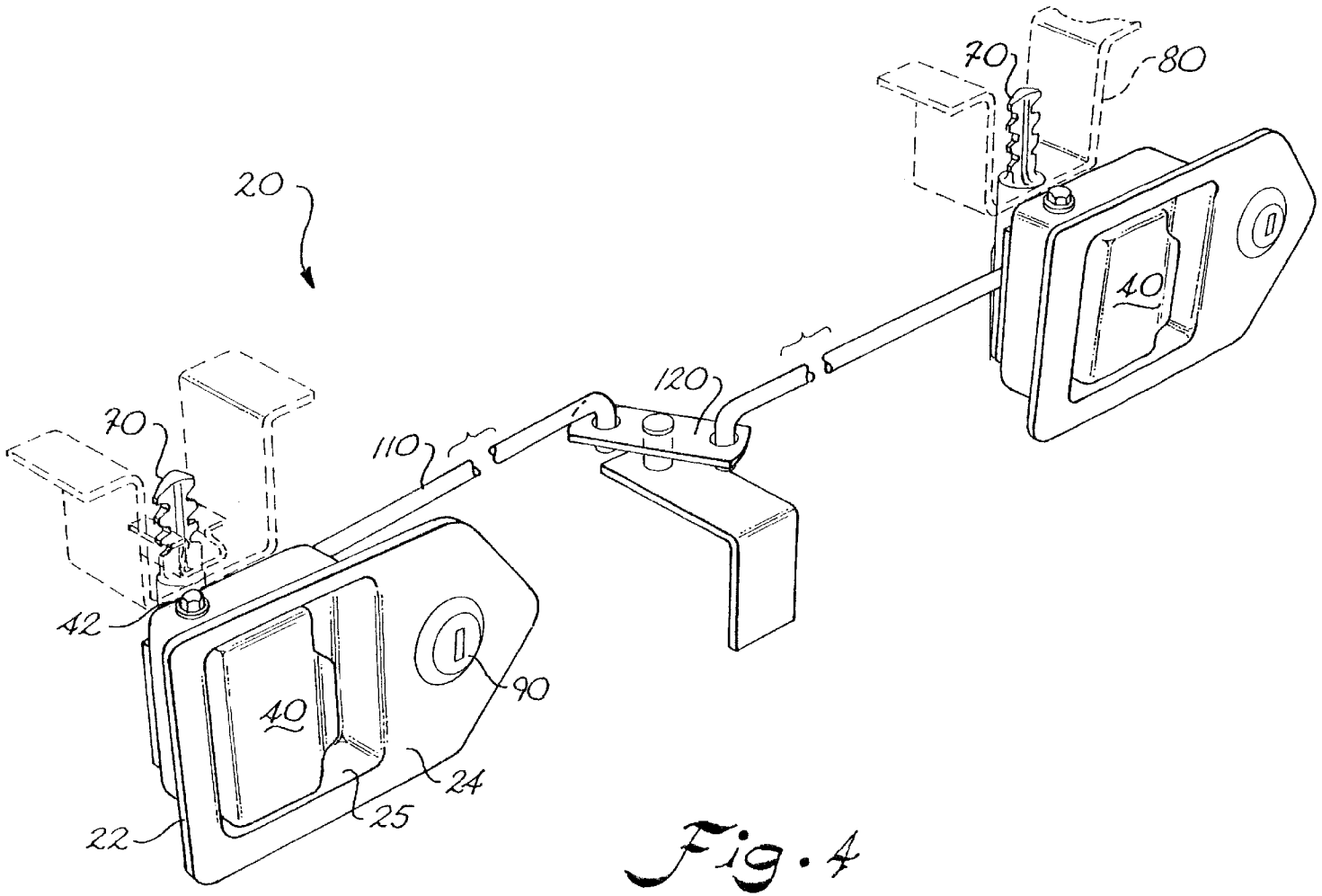
FIG. 4 is an operational front perspective view of the latch assembly useful in the cargo box seen in FIG. 3.

As seen in reference to FIG. 4, keeper stud 70 may engage receiving mechanism 80 so as the notches 75 of the distal end sidewalls engage a corresponding edge of the spaced apart tensioned lips 88 thereby providing a locked orientation. In this position, the lips clasp the notched side wall regions, the interengagement of lips 88 and notches 75 preventing the withdrawal of the keeper stud from the receiving mechanism 80.

To provide an unlocked keeper stud position, an operator would engage handle 40, pivoting the handle approximately 45 degrees. Movement of the handle in turn pivots actuating member 50 causing edge 52 to rotate operating member 60. The rotation of member 60 causes collar 64 to simultaneously rotate keeper stud 70 by the engagement of base 72. Ideally, in the illustrated embodiments, it is useful to rotate the keeper stud 70 approximately 90 degrees about its longitudinal axis, thereby positioning the smooth beveled edges 76 opposite the engaging lips 88. In this unlocked position, the relative movement between the beveled edges 76 and the opposing tensioned lips 88 is facilitated. Further, the distance between the notched walls 75 is greater than the distance between the smooth surfaced walls 76. As a result, the keeper stud may have the receiving mechanism more easily withdrawn when the smooth surface, thinner profile of walls 76 are positioned between the engaging edges of lips 88. Accordingly, a lid of a lock box carrying the receiving mechanism 80 can be opened by the withdrawal of the receiving mechanism 80 from the keeper stud.

Keeper stud base 72 may also be used to engage a receiving aperture 102 (FIG. 6) defined by a linkage rod cam 100. The linkage rod cam 100 and keeper stud base 72 are coupled together for integrated movement. In this manner, a linking rod 110 can connect via a turnbuckle 120 to a similar rod cam 100 of a second interlinked latch adjacent a first latch assembly (FIG. 4). This coupled, tandem arrangement enables simultaneous operation and control of both latch assemblies by the engagement of a single handle.

The coordinated movement of the latch assembly set forth here makes use of a keeper stud base 72 which is in coupled linkage with linkage rod cam 100 and operating member 60. As a result, keeper stud 70, linkage rod cam 100 and operating member 60 are interconnected so as to provide for integrated movement. Or, as stated another way, when any element of keeper stud 70, operating member 60, or linkage rod cam 100 is prevented from movement, none of the integrated individual parts will operate and paddle handle 40 will not pivot.

As a result, a variety of locking mechanisms may be used to limit the rotational movement of the integrated, coupled parts. One such mechanism can be provided by a key-operated lock mechanism 90 of conventional design such as a keyed cylinder which may be used to vary a position of a leg member 92 between a locked and an unlocked position. As seen in FIG. 7, leg member 92 may be used to block movement of linkage rod cam 100 thereby preventing the movement of keeper stud 70. As a result, the keeper stud 70 is maintained in a locked position relative to the receiver mechanism 80. It is apparent by those skilled in the art, that when two or more latch assemblies are interconnected by a common linking rod 110, or individual linking rods 110 connected by a turnbuckle 120 (FIG. 4), any single lock assembly which is maintained in a locked position will prevent the normal operation of both latch assemblies 20. In other words, locking any one of the latch assemblies will prevent the engagement of handle 40 and the subsequent engagement of actuating member 50, operating member 60, keeper stud 70, and linkage rod cam 100 of all interlinked latch assemblies 20. Thus, if desired, a lock assembly need only be provided on one of the two connected latch assemblies to achieve locking of both latch assemblies.

The present invention provides a novel latching mechanism which utilizes a notched keeper stud which is operatively connected to the handle and rotates in response to the engagement of the handle. The rotation allows the notched surfaces to disengage from a retaining edge disposed within a receiving element. As a result, the pivoting motion of the handle is translated into a rotational movement of the cylindrical keeper stud.

The use of a curved, convex surface to engage the operating member allows a greater movement of the operating member, without substantial increase in force required on the handle by the user, than would be achieved by a flat edge engaging surface. This arrangement allows a relatively short pivot motion of the handle to effect a proportionally increased distance of travel of the operating member. As a result, a ⅛ turn of the handle pivot results in a full ¼ turn of the stud keeper.

Further, the latch assembly provides a smooth fluid operation in which the initial pivoting motion of the handle achieves the greatest movement of the operating member, and hence, the keeper stud as well. In this manner, the initial movement of the handle where the user has the greatest leverage coincides where the greatest frictional force is need to overcome the positioning of the notched, wide edges of the keeper stud from engagement with the securing edges of the receiving mechanism. Also, the line of force at the point of contact between curved edge 52 and operating member changes as the handle is pulled, and the change serves to move the line of force to a more efficient orientation. That is, as the handle is pulled, the line of force approximates more closely a line tangent to a circle defined by the rotation of pin 62 around keeper stud 70.

It is envisioned that either the receiving mechanism or the keeper stud may be provided with a compression spring, a pneumatic lift or similar device as well known in the art to facilitate the automatic release of the receiving mechanism from the keeper stud when the keeper stud is rotated into a disengaged position.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

That which is claimed is:

1. A floating receiving mechanism for use with a handle assembly comprising:

a base plate fixedly mounted to a first surface, the base plate defining a central opening and at least two side openings therethrough, the side openings and central opening being spaced from the first surface, the side openings located on opposite sides of the central opening; and a keeper defining a central opening therethrough, the keeper being attached to the base plate via connection members extending from the keeper through the side openings so that the keeper central opening is substantially aligned with the base plate central opening, each connection member being sized so as to be slidable laterally in a respective side opening and so that each connection member is entirely spaced from and does not contact the first surface to thereby allow the keeper to move laterally relative to the base plate and the first surface, the keeper configured for releasably retaining an extending portion of the handle assembly and for movement relative to the base plate and the first surface during receipt of the extending portion to compensate for misalignment between the extending portion and the base plate.

2. The mechanism of claim 1, wherein the keeper is substantially U-shaped.

3. The mechanism of claim 1, wherein the keeper has a base portion and two arms extending from the base portion, the central opening being defined in the base portion.

4. The mechanism of claim 3, wherein each of the arms terminates in a lip.

5. The mechanism of claim 1, wherein the extending portion of the handle assembly is a rotatable member, the rotatable member being insertable into the keeper in any position of rotation and being withdrawable from the keeper in at least one unlocked position of rotation.

6. The mechanism of claim 5, wherein the rotatable member is operatively connected to the handle assembly.

7. The mechanism of claim 5, wherein the rotatable member is a keeper stud having a first terminus defining at least one notch, the notch engaging the keeper when the keeper stud is in a locked position of rotation and disengaging the keeper when the keeper stud is in the unlocked position of rotation.

8. The mechanism of claim 7, wherein the keeper stud includes a plurality of the notches arranged in at least one pair.

9. The mechanism of claim 1, wherein the base plate is secured to a lid of a container and the handle assembly is secured to the container.

10. A floating receiving mechanism for use with a handle assembly comprising:

a base member fixedly mounted to a first surface, the base member defining a central opening therethrough and slots located on opposite sides of the central opening, the slots and central opening being spaced from the first surface;

a substantially U-shaped keeper having a base portion defining a central opening therethrough and two arms extending from the base portion, the keeper being attached to the base member via connection members extending from the keeper through the slots and entirely spaced from and not in contact with the first surface so that the keeper central opening is substantially aligned with the base member central opening and so that the keeper is slidable laterally relative to the base member and the first surface, the keeper configured for releasably retaining an extending portion of the handle assembly and for movement relative to the base plate and the first surface during receipt of the extending portion to compensate for misalignment between the extending portion and the base plate.

11. The mechanism of claim 10, wherein each of the arms terminates in a lip.

12. The mechanism of claim 10, wherein the extending portion of the handle assembly is a rotatable member, the rotatable member being insertable into the keeper in any position of rotation and being withdrawable from the keeper in at least one unlocked position of rotation.

13. The mechanism of claim 12, wherein the rotatable member is operatively connected to the handle assembly.

14. The mechanism of claim 12, wherein the rotatable member is a keeper stud having a first terminus defining at least one notch, the notch engaging the keeper when the keeper stud is in a locked position of rotation and disengaging the keeper when the keeper stud is in the unlocked position of rotation.

15. The mechanism of claim 14, wherein the keeper stud includes a plurality of the notches arranged in at least one pair.

16. The mechanism of claim 10, wherein the base member is secured to a lid of a container and the handle assembly is secured to the container.

17. A handle latch assembly comprising:

a handle assembly including a rotatable member actuatable by a handle, the handle assembly mountable on a first surface and having an extending portion; and a receiving mechanism for releasably securing the extending portion, the receiving mechanism mountable on a second surface movable relative to the first surface, the receiving mechanism including a base member defining a central opening theretbrough and fixably mounted to the second surface;

a substantially U-shaped keeper having a base portion defining a central opening theretbrough and two arms extending from the base portion, the keeper being attached to the base member via connection members extending from the keeper through the base member and entirely spaced from and not in contact with the second surface so that the keeper central opening is substantially aligned with the base member central opening and so that the keeper is slidable laterally relative to the base member and the second surface, the keeper configured for releasably retaining the extending portion of the handle assembly and for movement relative to the base plate and the second surface during receipt of the extending portion to compensate for misalignment between the extending portion and the base plate.

18. The handle latch assembly of claim 17, wherein the extending portion of the handle assembly is a rotatable member, the rotatable member being insertable into the keeper in any position of rotation and being withdrawable from the keeper in at least one unlocked position of rotation.

19. The handle latch assembly of claim 18, wherein the rotatable member is a keeper stud having a first terminus defining at least one notch, the notch engaging the keeper when the keeper stud is in a locked position of rotation and disengaging the keeper when the keeper stud is in the unlocked position of rotation.

20. The handle latch assembly of claim 19, wherein the keeper stud includes a plurality of the notches arranged in at least one pair.

21. The handle latch assembly of claim 17, wherein the base member is secured to a lid of a container and the handle assembly is secured to the container.

22. The handle latch assembly of claim 17, further including means for slidably connecting the base member and the keeper.

23. The handle latch assembly of claim 22, wherein the means for slidably connecting include connection members slidably in openings.

24. The handle latch assembly of claim 22, wherein the openings are slots located on the base member.

25. A floating receiving mechanism for use with a handle assembly comprising:

a base plate defining a central opening and at least two side openings therethrough, the side openings located on opposite sides of the central opening; and a keeper defining a central opening therethrough, the keeper being attached to the base plate via connection members extending from the keeper through the side openings so that the keeper central opening is substantially aligned with the base plate central opening, each connection member being sized so as to be slidable laterally in a respective side opening to thereby allow the keeper to move laterally relative to the base plate, the keeper configured for releasably retaining an extending portion of the handle assembly, the extending portion of the handle assembly being a rotatable member, the rotatable member being insertable into the keeper in any position of rotation and being withdrawable from the keeper in at least one unlocked position of rotation.

26. The mechanism of claim 25, wherein the keeper is substantially U-shaped.

27. The mechanism of claim 25, wherein the keeper has a base portion and two arms extending from the base portion, the central opening being defined in the base portion.

28. The mechanism of claim 27, wherein each of the arms terminates in a lip.

29. The mechanism of claim 25, wherein the rotatable member is operatively connected to the handle assembly.

30. The mechanism of claim 28, wherein the rotatable member is a keeper stud having a first terminus defining at least one notch, the notch engaging the keeper when the keeper stud is in a locked position of rotation and disengaging the keeper when the keeper stud is in the unlocked position of rotation.

31. The mechanism of claim 30, wherein the keeper stud includes a plurality of the notches arranged in at least one pair.

32. The mechanism of claim 25, wherein the base plate is secured to a lid of a container and the handle assembly is secured to the container.

33. A floating receiving mechanism for use with a handle assembly comprising:

a base member defining a central opening therethrough;

a substantially U-shaped keeper having a base portion defining a central opening therethrough and two arms extending from the base portion, the keeper being attached to the base member so that the keeper central opening is substantially aligned with the base member central opening and so that the keeper is slidable laterally relative to the base member, the keeper configured for releasably retaining an extending portion of the handle assembly, the extending portion of the handle assembly being a rotatable member, the rotatable member being insertable into the keeper in any position of rotation and being withdrawable from the keeper in at least one unlocked position of rotation.

34. The mechanism of claim 33, wherein each of the arms terminates in a lip.

35. The mechanism of claim 33, wherein the rotatable member is operatively connected to the handle assembly.

36. The mechanism of claim 33, wherein the rotatable member is a keeper stud having a first terminus defining at least one notch, the notch engaging the keeper when the keeper stud is in a locked position of rotation and disengaging the keeper when the keeper stud is in the unlocked position of rotation.

37. The mechanism of claim 36, wherein the keeper stud includes a plurality of the notches arranged in at least one pair.

38. The mechanism of claim 33, wherein the base member is secured to a lid of a container and the handle assembly is secured to the container.

39. The mechanism of claim 33, further including means for slidably connecting the base member and the keeper.

40. The mechanism of claim 39, wherein the means for slidably connecting includes connection members slidable in openings.

41. The mechanism of claim 40, wherein the openings are slots located in the base member.

42. A handle latch assembly comprising:

a handle assembly including a rotatable member actuatable by a handle, the handle assembly mountable on a first surface and having an extending portion; and a receiving mechanism for releasably securing the extending portion, the receiving mechanism mountable on a second surface movable relative to the first surface, the receiving mechanism including a base member defining a central opening therethrough;

a substantially U-shaped keeper having a base portion defining a central opening therethrough and two arms extending from the base portion, the keeper being attached to the base member so that the keeper central opening is substantially aligned with the base member central opening and so that the keeper is slidable laterally relative to the base member, the keeper configured for releasably retaining an extending portion of the handle assembly, the extending portion of the handle assembly being a rotatable member, the rotatable member being insertable into the keeper in any position of rotation and being withdrawable from the keeper in at least one unlocked position of rotation.

43. The handle latch assembly of claim 42, wherein the rotatable member is a keeper stud having a first terminus defining at least one notch, the notch engaging the keeper when the keeper stud is in a locked position of rotation and disengaging the keeper when the keeper stud is in the unlocked position of rotation.

44. The handle latch assembly of claim 43, wherein the keeper stud includes a plurality of the notches arranged in at least one pair.

45. The handle latch assembly of claim 42, wherein the base member is secured to a lid of a container and the handle assembly is secured to the container.

46. The handle latch assembly of claim 42, further including means for slidably connecting the base member and the keeper.

47. The handle latch assembly of claim 46, wherein the means for slidably connecting include connection members slidably in openings.

48. The handle latch assembly of claim 47, wherein the openings are slots located on the base member.

49. The handle latch assembly of claim 42, further including connection members extending from the keeper through slots extending through the base member, the connection members configured to allow the keeper to slide laterally relative to the base member.

* * * * *

UNITED STATES PATENT AND TRADEMARK OFFICE

CERTIFICATE OF CORRECTION

PATENT NO. : 6,783,163 B2
DATED : August 31, 2004
INVENTOR(S) : Sadler

It is certified that error appears in the above-identified patent and that said Letters Patent is hereby corrected as shown below:

Column 8,
Lines 61 and 64, change “theretbrough” to -- therethrough --.

Column 9,
Line 34, change “The mechanism of claim 22” to -- The mechanism of claim 23 --.
Line 67, change “The mechanism of claim 28” to -- The mechanism of claim 25 --.

Signed and Sealed this

Seventh Day of December, 2004

JON W. DUDAS
*Director of the United States Patent and Trademark Office*